United States Patent [19]

Zimermann et al.

[11] Patent Number: 4,788,633

[45] Date of Patent: Nov. 29, 1988

[54] DEVICE WITH COMPOSITE REFLECTOR

[75] Inventors: Robert W. Zimermann, Sun Prairie; David R. Schaller, Janesville, both of Wis.

[73] Assignee: Rayovac Corporation, Madison, Wis.

[21] Appl. No.: 88,582

[22] Filed: Aug. 24, 1987

[51] Int. Cl.[4] ..... T21L 7/00

[52] U.S. Cl. ..... 362/296; 362/247; 362/205; 362/188

[58] Field of Search ..... 362/296, 197, 247, 202, 362/205

[56] References Cited

U.S. PATENT DOCUMENTS

| | | | |
|---|---|---|---|
| 1,148,101 | 7/1915 | Kush | 362/247 |
| 1,194,658 | 8/1916 | Pagin | 362/247 |
| 1,205,916 | 11/1916 | Meador | 362/247 |
| 1,214,583 | 2/1917 | Persons | 362/247 |
| 1,226,325 | 5/1917 | Garomanos | 362/247 |
| 1,287,611 | 12/1918 | Barnes | 362/247 |
| 1,303,766 | 5/1919 | Brown | 362/247 |
| 1,559,930 | 11/1925 | Bean | 362/247 |
| 1,889,936 | 12/1932 | Shannon | 362/202 |
| 2,408,643 | 10/1946 | Hoy | 362/197 |
| 3,711,699 | 1/1973 | Bacevius | 362/197 |
| 4,388,673 | 6/1983 | Maglica | 362/205 |
| 4,570,208 | 2/1986 | Sassmannshausen | 362/205 |

*Primary Examiner*—Raymond A. Nelli

*Attorney, Agent, or Firm*—Kenyon & Kenyon

[57] ABSTRACT

A device generates several collimated light beams from several light sources and a composite reflector. The light sources are positioned so that a reflector section reflects the light from a light source in a preselected beam. The device is of compact nature, both collimated beams emanating from a structure approximately the size of a standard reflector for one beam.

6 Claims, 1 Drawing Sheet

DEVICE WITH COMPOSITE REFLECTOR

RELATED APPLICATIONS: the subject matter of the present application is related to the following copending commonly owned patent applications: Ser. No. 088,583 filed Aug. 24, 1987 entitled A UNIQUE OPTICAL SYSTEM FOR GENERATING MULTIPLE LIGHT BEAMS FROM A SINGLE SOURCE: Ser. No. 088,679 filed Aug. 24, 1987 entitled A FLASHLIGHT WITH SPACE EFFICIENT REFLECTOR: Ser. No. 081,655 filed Aug. 4, 1987 entitled A FLASHLIGHT WITH BACKUP SYSTEM.

BACKGROUND OF THE INVENTION a. Field of Invention

This invention pertains to a device with a composite reflector for generating light beams for several light sources. The device is particularly useful in flashlights with multiple lamps.

b. Description of the Prior Art

Various devices are known which make use of several light sources disposed in a single subassembly for generating separate light beams. However in all these devices separate reflectors must be used to obtain a well defined beam. For example U.S. Pat. No. 2,498,643 discloses a flashlight with a head having two light bulbs and two reflectors pointing in opposite directions. U.S. Patent Nos. 1,287,611 and 1,226,325 disclose automobile headlights in which light from two separate sources are shaped into beams with reflectors separated by baffles. U.S. Pat. No. 1,889,936 shows a flashlight with three different bulbs and a single reflector. However at most only one of the bulbs is disposed at the focal point of the reflector and therefore only one of the corresponding light beams is well defined. All the other beams must be out of focus and difused.

OBJECTIVES AND SUMMARY OF THE INVENTION

In view of the abovementioned disadvantages of the prior art it is an objective of the present invention to provide an arrangement for generating two or more well-defined light beams from corresponding individual light sources using a composite reflector.

Another objective is to provide an arrangement which is space-efficient and easy to manufacture, whereby the arrangement is particularly suitable for hand-held flashlights.

Other objectives and advantages of the invention shall become apparent from the following description.

The invention takes advantage of the form of the polar light pattern generated by light sources. Many practical light sources generate a pattern which is approximately spherical and disposed on one side of the source along its optical axis. As a result there is a region disposed on the axis on the other side of the source which receives virtually no light from the source. In the invention, a composite reflector is used with several reflector sections, each reflector section corresponding to a light source. The reflector sections have reflector optical axes which are preferably common or in parallel, and different focal points. Each light source is disposed at the focal point of the corresponding reflector section with the source optical axis intersecting the reflector optical axis.

BRIEF DESCRIPTION OF THE INVENTION

DETAILED DESCRIPTION OF THE INVENTION

Figure 1:
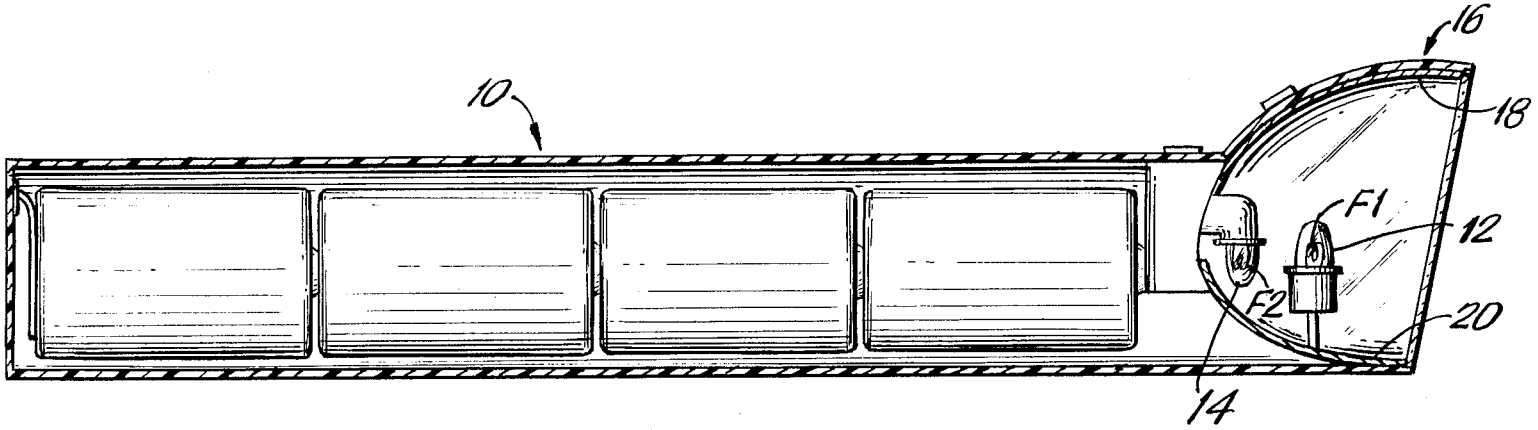
FIG. 1 shows a flashlight incorporating the present invention.

A flashlight 10 incorporating the subject invention is shown in FIG. 1. The flashlight has two light sources 12 and 14 which may be provided with individual power circuits as described in the abovementioned copending application Ser. No. 081,655, filed Aug. 4, 1987, entitled A FLASHLIGHT WITH BACKUP SYSTEM. The flashlight is also provided with a composite reflector 16. The composite reflector 16 resembles physically a standard paraboloidal reflector and occupies approximately the same space, but in fact it comprises two reflector sections 18 and 20. The two reflector sections have parallel or common optical axes and each has a focal point F1 and F2 respectively. Light sources 12 and 14 may be incandescent light bulbs, light emitting diodes, specially shaped fluorescent elements, or any other similar devices with polar pattern at least approximately as shown in FIG. 2.

Figure 3:
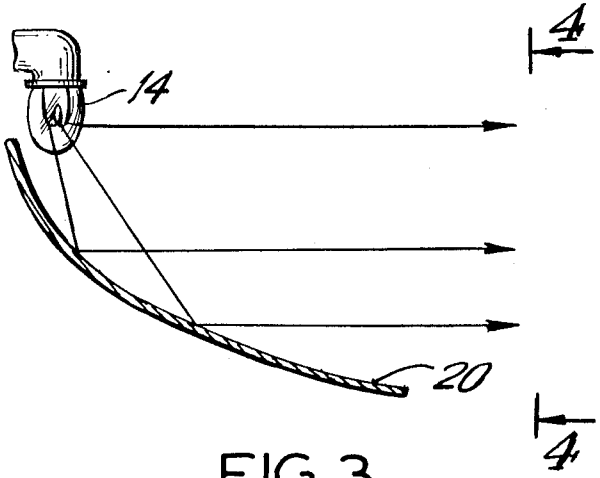
FIG. 3 shows how a light beam is generated by a light source and a reflector section of the flashlight of FIG. 1.
Figure 2:
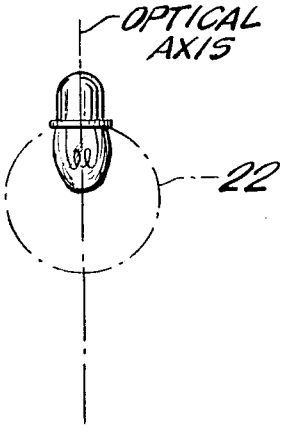
FIG. 2 shows the light pattern generated by a light source of FIG. 1.

As shown in FIG. 2 each source 12, 14 generates an approximately spherical light pattern 22 disposed in front of the source on the source optical axis. Behind the source there is a region which receives virtually no light from the source. Therefore the light sources are positioned so that their optical axis traverses the optical axis of the corresponding reflector sections. As a result the dark region of the source is disposed away from the reflector section and has no effect on the beam generated thereby, as shown in FIGS. 1 and 3.

Figure 4:
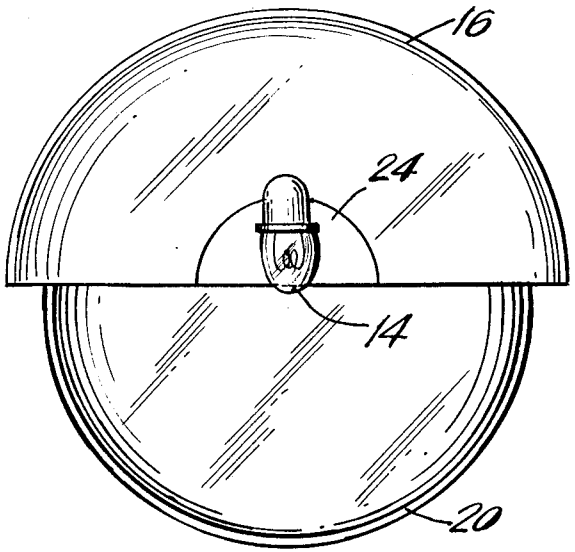
FIG. 4 shows an end view of the reflector section and light source of FIG. 3.

Each light source may be provided with a reflective socket 24 as shown in FIG. 4. Thus a flashlight or any other device equipped with several light sources disposed at or near the focal point of several reflector sections can generate light beams having a preselected shape. If a beam of parallel light rays is desired, the reflector sections can be hemiparaboloidal as shown in the figures.

At least one of the lamps may be relatively small, such as a Tl lamp, to minimize interference with the other lamp. Preferably the smaller lamp (in a flashlight with back up system) is the back up lamp.

Obviously numerous modifications may be made to the invention without departing from its scope as defined in the appended claims.

We claim:

1. A device for generating a plurality of light beams comprising:

a plurality of light sources, each light source having a source optical axis; and a common chamber for housing said light sources, said chamber being defined by a plurality of reflector surfaces joined to form a continuous composite reflector, each reflector surface having a reflector axis and a focal point corresponding to one of said light sources, each source optical axis traversing a corresponding reflector optical axis.

2. The device of claim 1 wherein said reflector sections are hemiparaboloidal.

3. The device of claim 1 where said reflector axes are in parallel.

4. A flashlight comprising:

a chamber defined by a pair of reflector surfaces joined to form a composite reflector, with each surface having a reflector optical axis and a focal point; and a pair of light sources disposed in said chamber at said focal points, said light sources each having a source optical axis traversing the corresponding reflector optical axis.

5. The flashlight of claim 5 wherein said reflector sections are hemiparaboloidal.

6. The device of claim 1 wherein said reflector axes are common.

* * * * *